US005314032A

United States Patent [19]

Pringle et al.

[11] Patent Number: 5,314,032

[45] Date of Patent: May 24, 1994

[54] MOVABLE JOINT BENT SUB

[75] Inventors: Ronald E. Pringle, Houston; Arthur J. Morris, Magnolia, both of Tex.

[73] Assignee: Camco International Inc., Houston, Tex.

[21] Appl. No.: 61,953

[22] Filed: May 17, 1993

[51] Int. Cl.[5] ..... E21B 7/08

[52] U.S. Cl. ..... 175/74; 166/66.4; 175/321; 175/256; 285/184

[58] Field of Search ..... 175/74, 73, 61, 256, 175/321; 166/65.1, 66.4; 285/184, 86, 316, 315

[56] References Cited

U.S. PATENT DOCUMENTS 5,048,621 9/1991 Bailey et al. ..... 175/74
5,070,950 12/1991 Cendre et al. ..... 175/74
5,101,915 4/1992 Witte ..... 175/74
5,125,463 6/1992 Livingstone et al. ..... 175/74

*Primary Examiner*—Stephen J. Novosad
*Attorney, Agent, or Firm*—Fulbright & Jaworski

[57] ABSTRACT

A movable joint bent sub for attachment to a well conduit for use in deviated drilling of a well. An elongated housing is provided having one end for attachment to a well conduit, a mandrel is telescopically movable in the bore of the housing, and a movable body is pivotally connected to the mandrel and is longitudinally movable in the housing. Coacting cam surfaces on the body in the housing pivot the body to a desired deviation when the mandrel is telescopically moved in the bore. A releasable lock may be provided between the mandrel and the housing.

13 Claims, 9 Drawing Sheets

MOVABLE JOINT BENT SUB

BACKGROUND OF THE INVENTION

The present invention is generally directed to a bent sub having a movable joint where the sub can be run in a straight position and can then be bent at an angle and used in a bottom hole assembly for changing the drilling direction.

In drilling oil and gas wells, it is sometimes desirable to deviate from the vertical or even drill in a horizontal direction. In order to drill deviated wells, a bottom hole assembly consisting of several tools for steering, guiding, orienting and drilling are used. The bottom hole assembly includes a bent sub which is a device that is bent at an angle, such as from 2° to 7°. Data is electronically transmitted to the surface for monitoring proper location and direction. If the direction or depth of drilling needs to be changed, the bottom hole assembly is rotated.

While the present invention is useful in conventional deviated drilling with rotary rigs, the present invention is particularly useful in drilling with coiled tubing which cannot rotate (only the motor and drill bit rotate). In particular, the present invention solves a problem of entering existing oil or gas wells having production tubing in place, and then drilling with coiled tubing out of the bottom of the production tubing and at angle to the vertical. However, in such an application, the bent sub must be straight as it enters the well at the surface in order to pass through the interior of the production tubing, and then bend to a specified angle as it exits the production tubing at the bottom in order to drill the deviated well. If direction or depth needs to be changed, an orienting tool is activated resulting in rotation of the bottom hole assembly.

SUMMARY

The present invention is directed to a movable joint bent sub for attachment in a well conduit for use in deviated drilling of a well. The bent sub generally includes an elongate housing have a bore therein and having first and second ends in which the first end includes connecting means for attachment in a well conduit. A mandrel is telescopically movable in the bore and a movable body is provided having first and second ends in which the second end has connecting means for attachment in the well conduit. The first end of the movable body is pivotally connected to the mandrel and is slidable into the second end of the housing. Coacting cam surfaces on the body and the housing are provided for pivoting the second end of the body when the body is telescopically moved in the bore.

Still a further object of the present invention is the provision of means preventing rotation of the body around the longitudinal axis relative to the housing. Preferably, the preventing means includes a key and a coacting keyway, one of which is on the housing, and the other of which is on the body.

Still a further object of the present invention is wherein the pivot connection between the mandrel and the body is a universal joint.

Yet a still further object of the present invention is wherein the cam surface on the body is a replaceable insert for providing different degrees of pivoting angle with different inserts.

Yet a still further object of the present invention is the provision of a shoulder on the mandrel for engaging the body when the body is pivoted. Preferably, the angle of the shoulder is variable for carrying loads at different angles.

Still a further object of the present invention is wherein releasable locking means is provided between the mandrel and the housing. In one embodiment the locking means includes an electrical locking means. In another embodiment a piston is connected to the mandrel and the locking means includes hydraulic locking means. In still a further embodiment locking means includes an electrically actuated pump and valve controlling a hydraulic piston actuated lock or a hydraulic piston on the mandrel.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

Figure 1A:
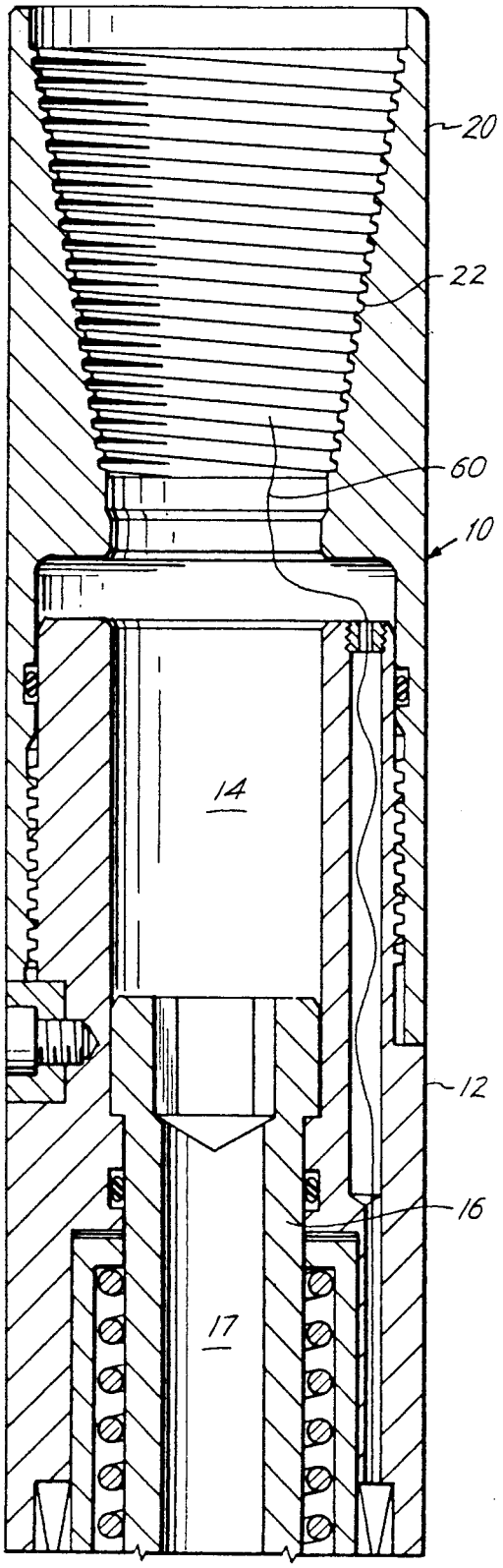
FIGS. 1A, 1B and 1C are continuations of each other and together form an elevational view, in cross section, of one embodiment of the present invention in a straight position.

While the bent sub of the present invention will be described, for purposes of illustration only, as being connected in a coiled tubing drilling string for being run through production tubing in an aligned position and thereafter bent for deviated drilling, the present bent sub is also useful for conventional rotary type deviated drilling.

Referring now to the drawings, and particularly to FIGS. 1A, 1B and 1C, 2 and 3, the reference numeral 10 generally indicates the bent sub of the present invention shown in an aligned or straight position for moving down a well hole and particularly through existing well production tubing. The sub generally includes an elongate housing 12 having a bore 14 therethrough, a mandrel 16 telescopically movable in the bore 14 and having a bore 17, and a movable body 18.

The housing has a first end 20 having connecting means such as threads 22 for connection in a well conduit, and a second end 24. The movable body 18 has a first end 26 having connecting means such as threads 28. The body has a bore 19 in communication with bores 17 and 14. The body 18 has a second end 27 pivotally connected to the mandrel 16. Preferably, the pivot connection is a universal type ball and socket joint. In addition, the second end 27 of the body 18 is slidable into the second end 24 of the housing 12.

Figure 4A:
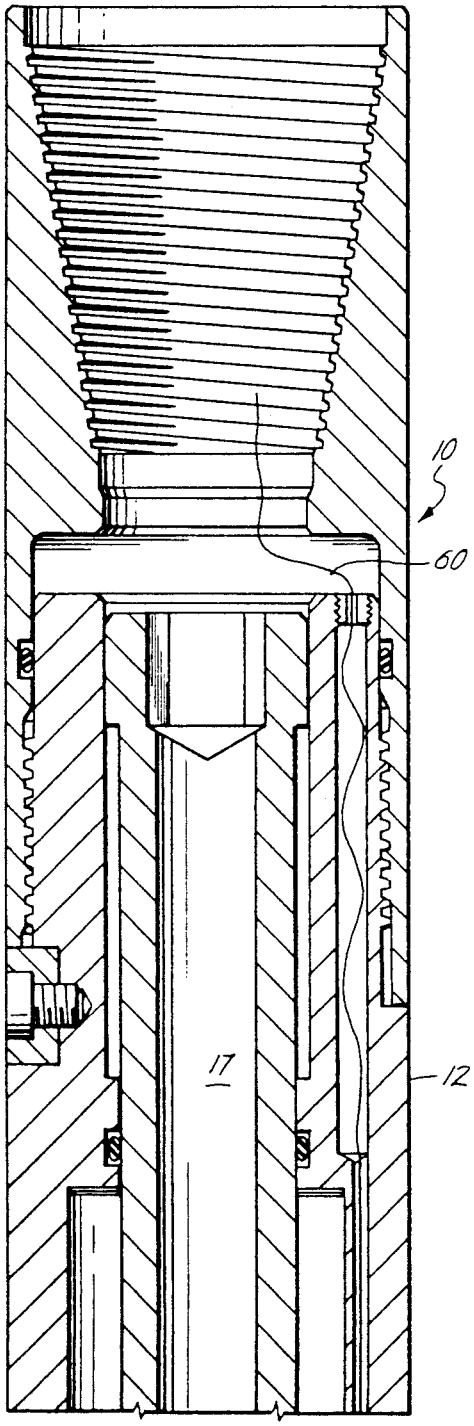
Figure 4B:
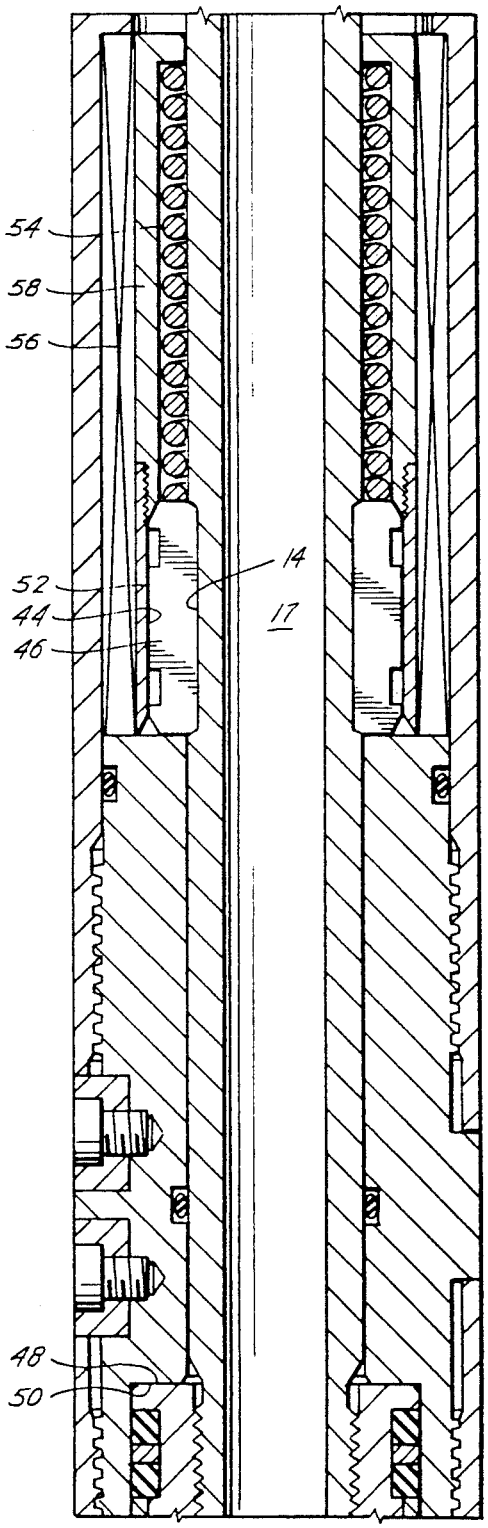
Figure 4C:
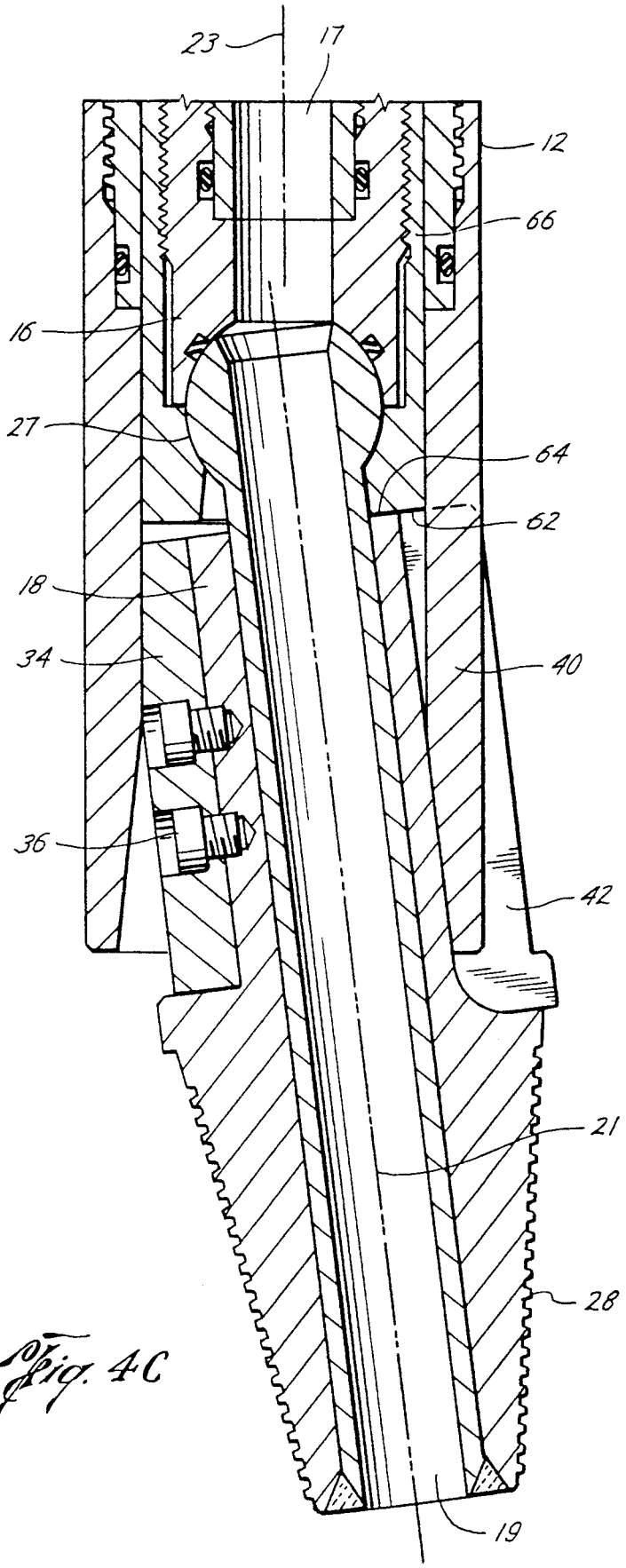

Coacting cam surfaces are provided on the body 18 and on the housing 12 for pivoting the second end 26 of the body 18 when the body is telescopically moved in the bore 14 of the housing 12. Thus, a cam surface 30 is provided on the body 18 and a cam surface 32 is provided on the housing 12 for shifting the longitudinal axis 21 of the body 18 relative to the longitudinal axis 23 of the housing 12 to a bent angle, as best seen in FIGS. 4A, 4B and 4C and particularly 4C. The angle at which the bent sub is moved is conventionally from about 2° to about 7°. The amount of the angle, of course, is determined by the coacting cam surfaces 30 and 32. In order to easily change the preset angle of the bent sub 10 prior to installation, a replaceable insert 34 (FIGS. 1C and 2) is releasably connected to the body 18 by bolts 36. Thus, by using various inserts with different cam angles 30, the desired amount of bend in the sub 10 can be provided. In order to properly direct the lower or first end 36 of the body 18, means are provided for preventing rotation of the body 18 about its longitudinal axis 21, such as a key and coacting keyway. Thus, a key 40 (FIGS. 1C and 3) are provided on one of the housing 12 and body 18, such as the housing 12 and a keyway 42 are provided on the other such as the body 18. Thus, as the body 18 longitudinally moves relative to the housing 12, the key 40 moves along the keyway 42 preventing rotation of the body around its longitudinal axis 21.

Figure 1B:
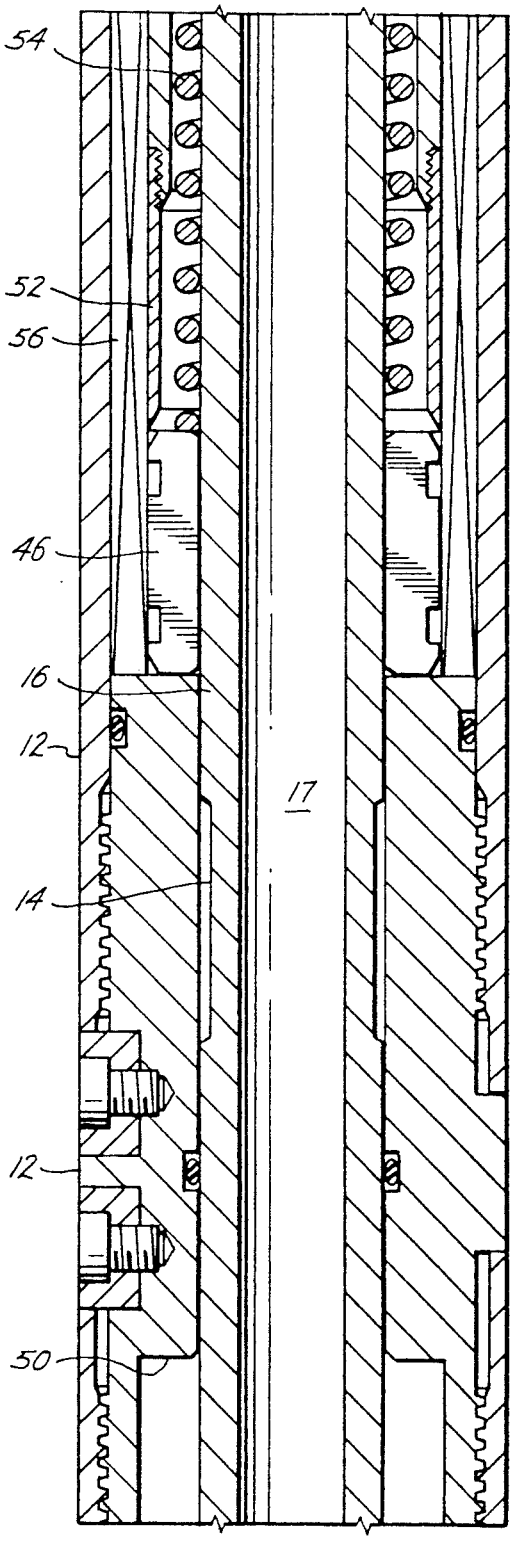
Figure 1C:
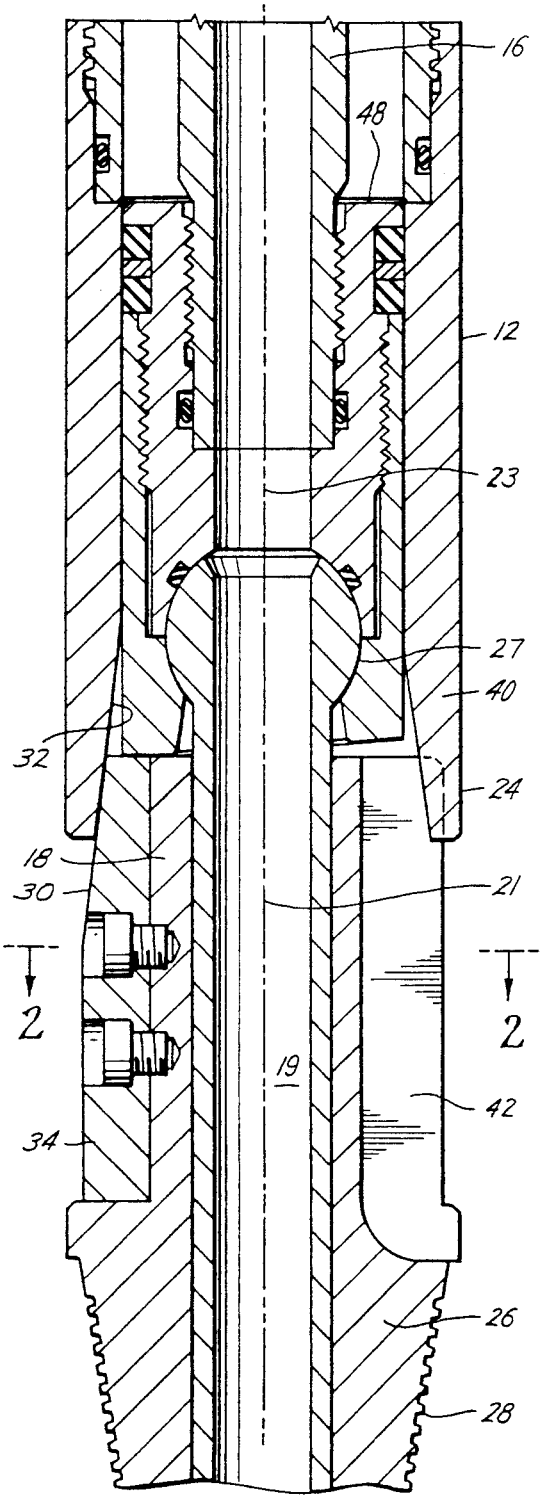
Figure 2:
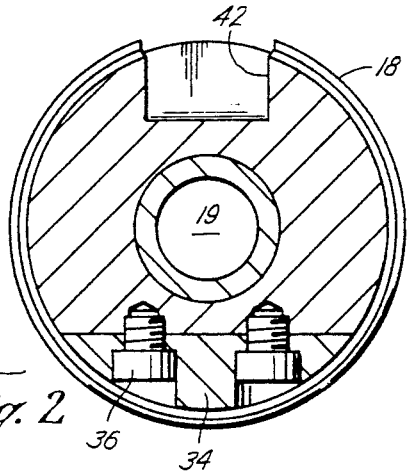
FIG. 2 is a cross-sectional view taken along 2—2 of FIG. 1C.
Figure 3:
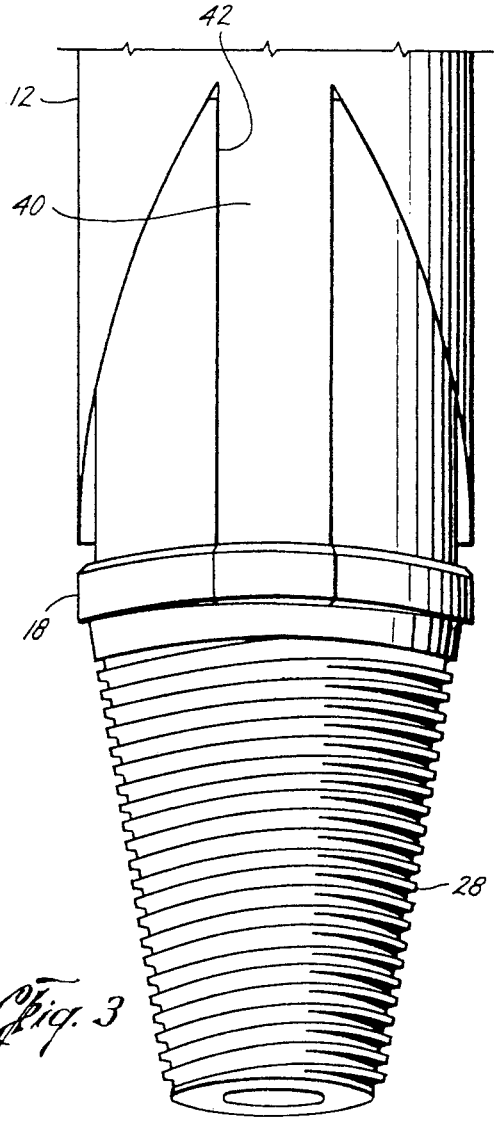
FIG. 3 is an elevational view of the lower end of FIG. 1C, FIGS. 4A, 4B and 4C are continuations of each other and form an elevational view, in cross section, of the bent sub of FIGS. 1A, 1B and 1C in a bent and locked position.

While the bent sub 10 may be activated from the position shown in FIGS. 1A–1C to that shown in FIGS. 4A–4C by any suitable means, the preferred method is to set down the housing 12, after the bent sub 10 and its connected bottom hole assembly is riding on the bottom of the well bore, thereby allowing the housing 12 to move downwardly over the body 18 and move the body 18 to the desired deviation angle.

After the housing 12 and the body 18 have been activated to provide the desired angle, it is then desirable to lock the housing 12 and the body 18 in place. Referring now to FIG. 1B, the mandrel 16 includes a locking recess 44 and the housing 44 includes a plurality of locking dogs 46. When the housing 12 is moved downwardly relative to the mandrel 16 and body 18 for activating the sub 10, a shoulder 48 (FIG. 1C) on the mandrel 18 contacts a shoulder 50 (1B), as best seen in FIG. 4B, thereby bringing the locking recess 44 in alignment with the dogs 46. A locking sleeve 52 which is normally yieldably urged away from the dogs 46 by spring 54, is actuated by an electrical solenoid coil 56 and armature 58 to bring and hold the sleeve 52 behind the dogs 46 and lock them in place. The solenoid 56 is actuated by an electrical conductor 60 preferably extending through the bore 14 of the bent sub 10 and extending to the well surface for actuation. Therefore, the bent sub is actuated and locked in position as best shown in FIGS. 4A–4C.

As best seen in the activated position in FIG. 4C, a loading shoulder 62 on the mandrel 16 engages a shoulder 64 on the body 18. As the angle of the shoulder 62 will need to be varied depending upon the angle of deviation of the longitudinal axis 21 of the body relative to the axis 23 of the housing, the shoulder 62 is preferably provided on a replaceable collar 66 on the mandrel 16. Thus, the collar 66 may be changed out and varied along with the insert 34 depending upon the angle of bend that is desired.

In use, the bent sub 10 is aligned in the vertical position as is best seen in FIGS. 1A–1C and lowered through the production tubing in a well, bottomed out, and then bent to the desired angle and locked in place. When it is desired to retrieve the bottom hole assembly including the bent sub 10 the solenoid 56 is deactuated allowing the bent sub 10 to move back to the vertical position and be retrieved through the well production tubing.

Figure 5A:
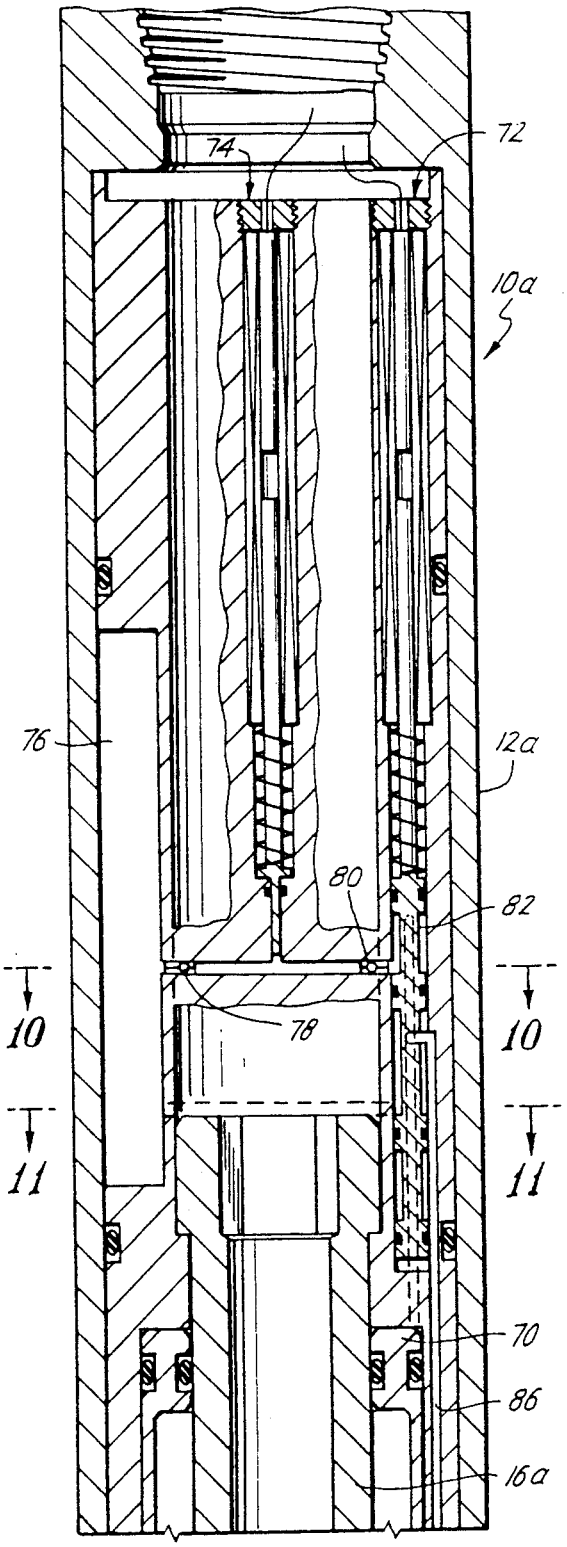
FIGS. 5A, 5B and 5C are continuations of each other and form an elevational view, in cross section, of another embodiment of a bent sub of the present invention.
Figure 5B:
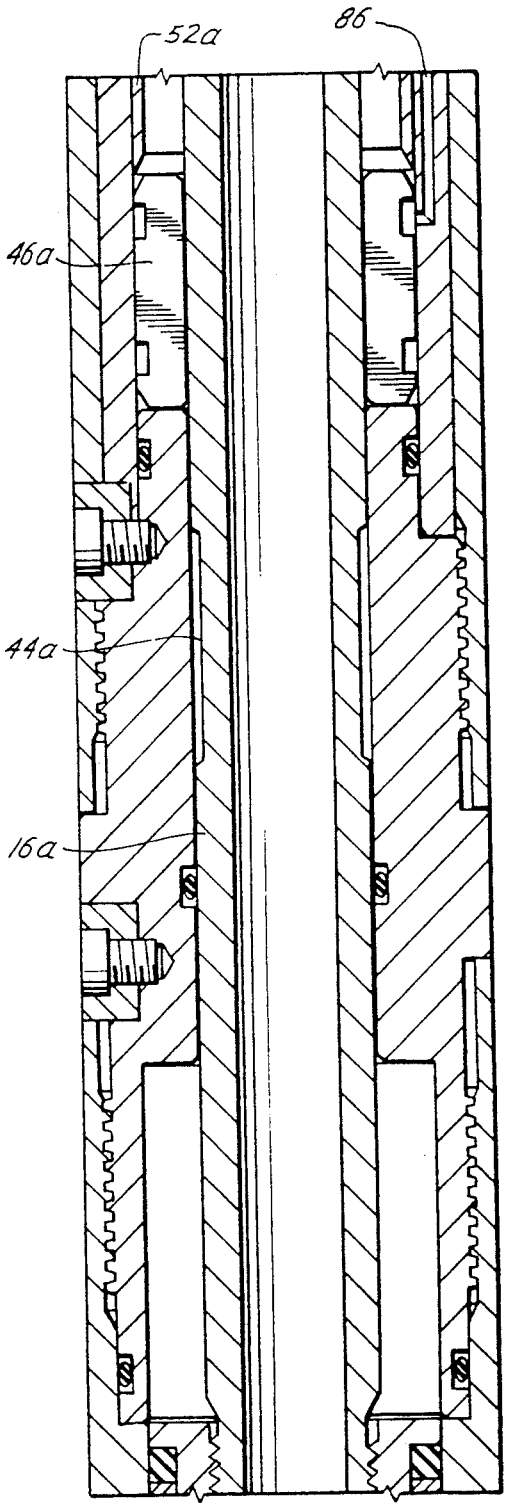
Figure 5C:
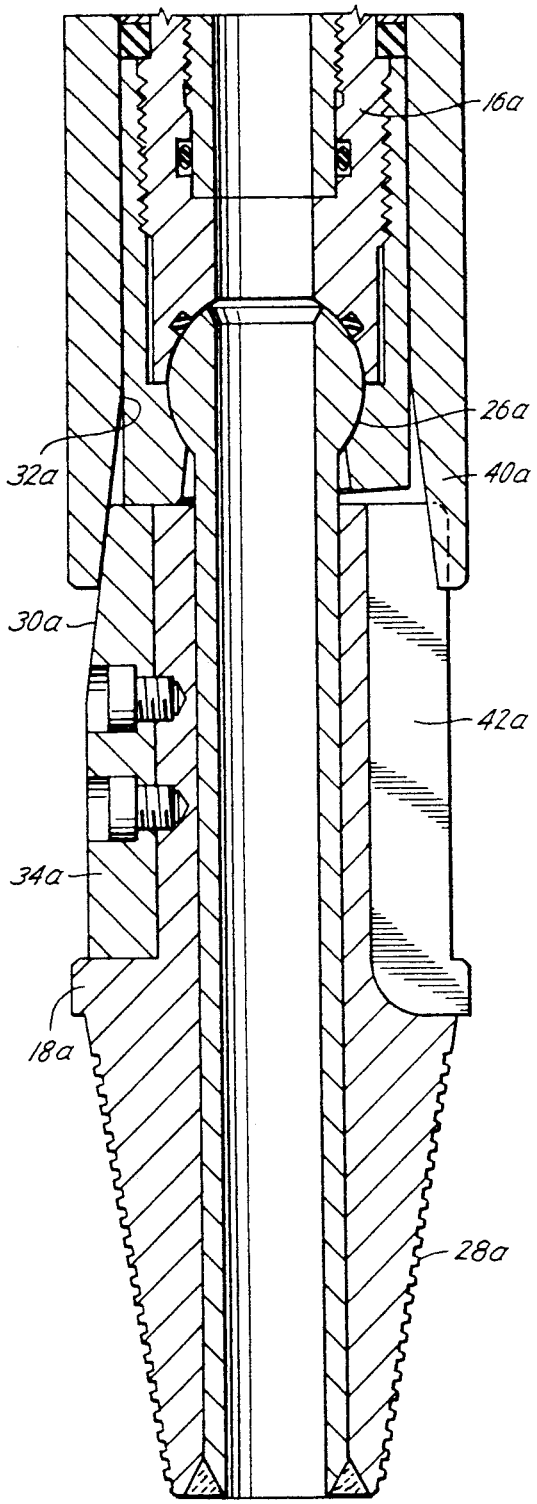

Other and further embodiments may be provided, as hereinafter described, wherein like parts to those shown in FIGS. 1A–1C will be similarly numbered with the addition of the suffix "a" and "b". Referring now to FIGS. 5A, 5B and 5C, a bent sub **10*a* is shown having a housing 12*a* which, when moved relative to the body 34*a*, pivots the body about the universal joint 27*a* to an angle determined by the cam surfaces 30*a* and 32*a* and brings the locking recess 44*a* into alignment with the locking dogs 44*a*, all as previously described in connection with FIGS. 1A–1C. However, in this embodiment, the locking sleeve 52*a* is moved behind the dogs 46*a* by the action of a hydraulic piston 70 which is moved between a locked and unlocked position by hydraulic fluid controlled by an electric valve 72 and an electric pump 74 from a reservoir 76**.

Figure 12A:
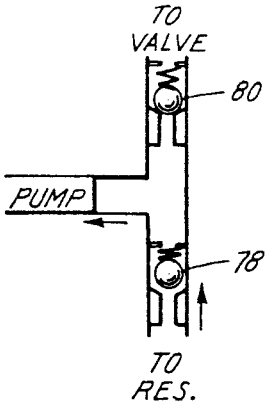
Figure 12B:
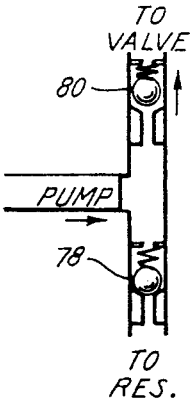

Referring to FIGS. 12A and 12B, the reciprocation of the solenoid actuated electrical pump 74 alternately brings fluid through a check valve 78 from the reservoir in FIG. 12A and alternately through a check valve 80 to the valve 72.

Figure 6A:
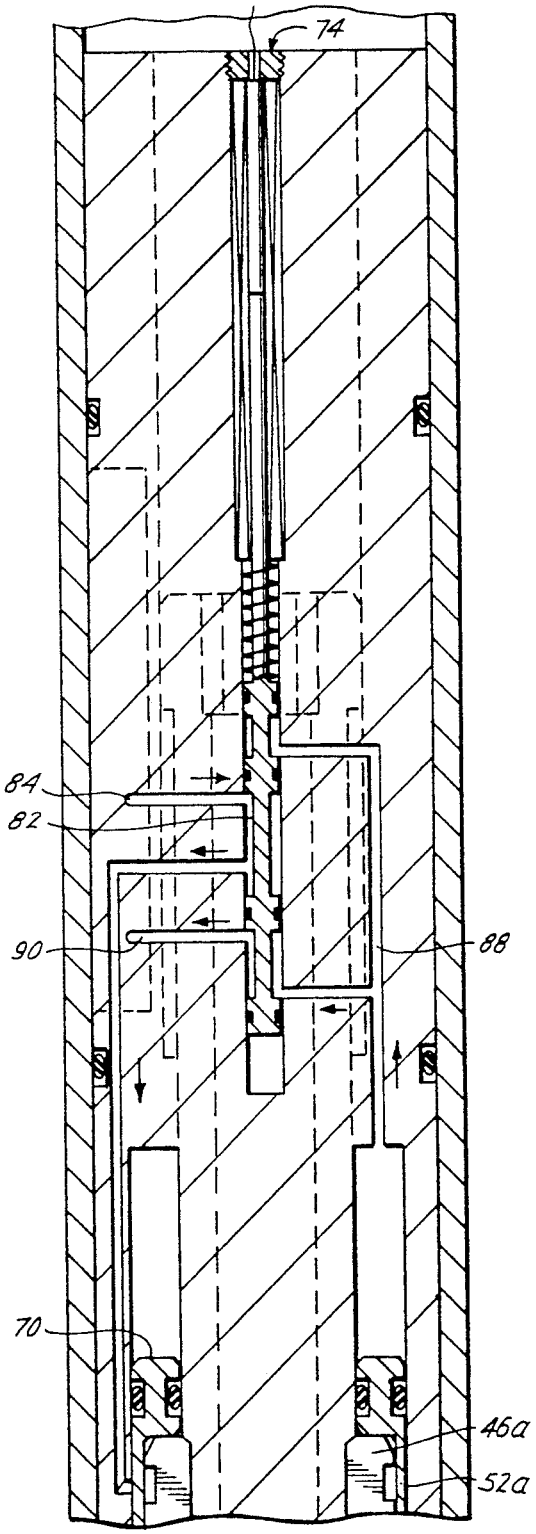
FIG. 6A is a schematic view of the electrical and hydraulic control system of the embodiment of FIGS. 5A–5C, shown in the unlocked position.
Figure 6B:
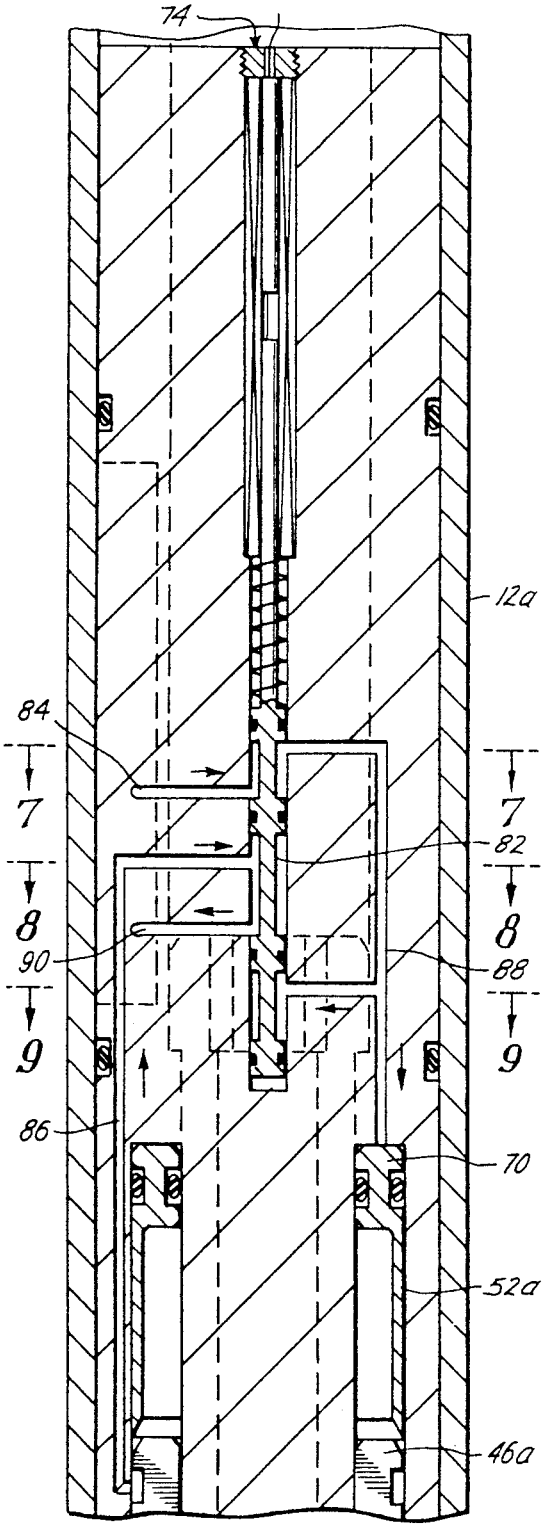
FIG. 6B is a schematic view similar to that of FIG. 6A but showing the control system in the locked position.
Figure 7:
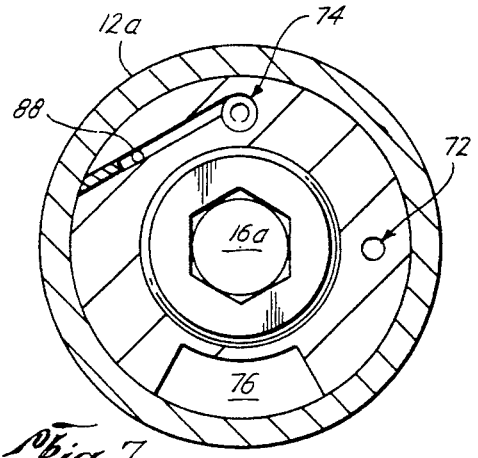
FIG. 7 is a cross-sectional view taken along the line 7—7 of FIG. 6B.
Figure 8:
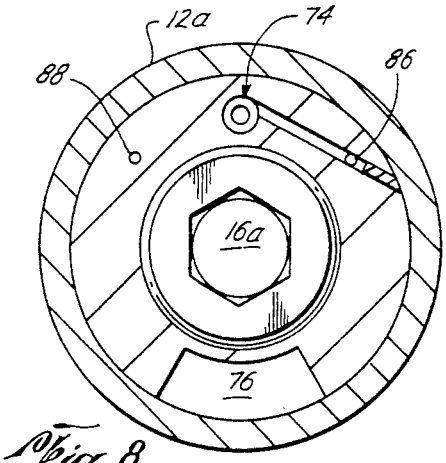
FIG. 8 is a cross-sectional view taken along the line 8—8 of FIG. 6B.
Figure 9:
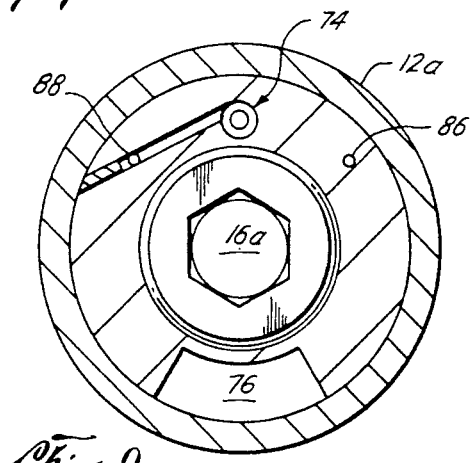
FIG. 9 is a cross-sectional view taken along the line 9—9 of FIG. 6B.
Figure 10:
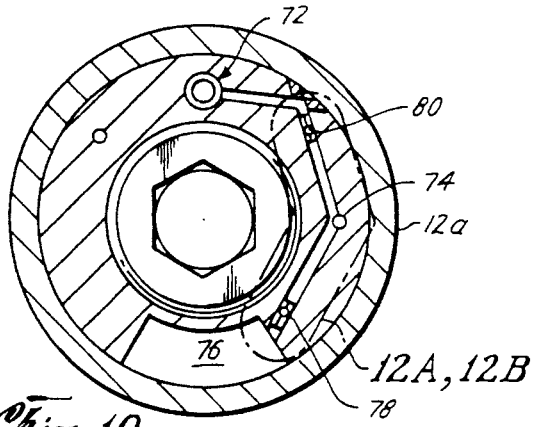
FIG. 10 is a cross-sectional view taken along the line 10—10 of FIG. 5A.
Figure 11:
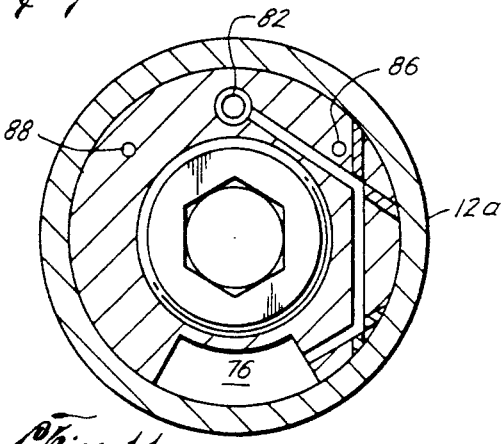
FIG. 11 is a cross-sectional view taken along the line 11—11 of FIG. 5A, FIGS. 12A and 12B are schematic representations of the dotted area of FIG. 10 showing the fluid flow of the pump in one direction in FIG. 12A and showing the fluid flow of the pump in the second direction in FIG. 12B, and FIGS. 13A, 13B and 13C are continuations of each other and form an elevational view, in cross section, of a further embodiment of the present invention.

As best seen schematically in FIGS. 6A and 6B, the valve 72 includes a spool 82 which, when moved to the position shown in FIG. 6A, unlocks the bent sub **10*a*. That is, fluid from the pump 72 flows through line 84 to the spool 82 where it is directed to line 86 on the back side of the piston 70 to move the piston 70 to the unlocked position. The hydraulic fluid on the top of the piston 70 flows through line 88 and the spool 82 directs the fluid to line 90 back to reservoir 76**.

When the valve 72 is actuated to its alternative position, as best seen in FIG. 6B, fluid from the pump through line 84 is directed by the spool 82 to line 88 and to the top of the piston 70 to move the locking sleeve **51*a* behind the dogs 46*a*. Fluid on the underside of the piston 70 is pushed out of the line 86 and is directed by the spool 82 to the line 90 to the reservoir 76**.

Figure 13A:
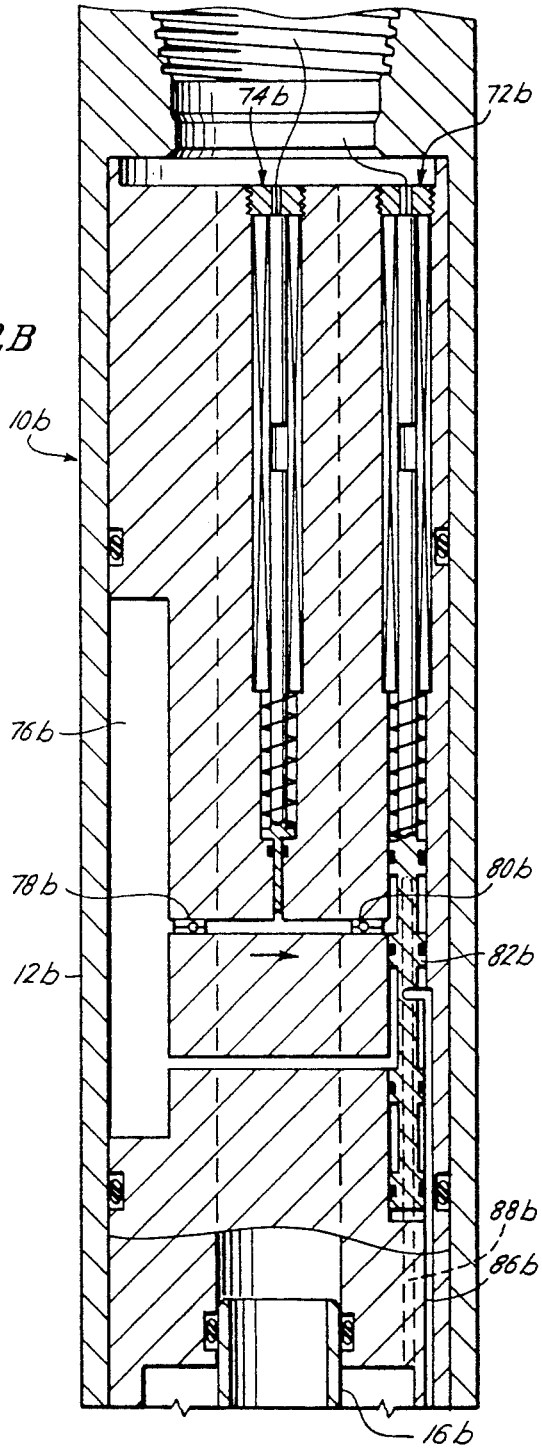
Figure 13B:
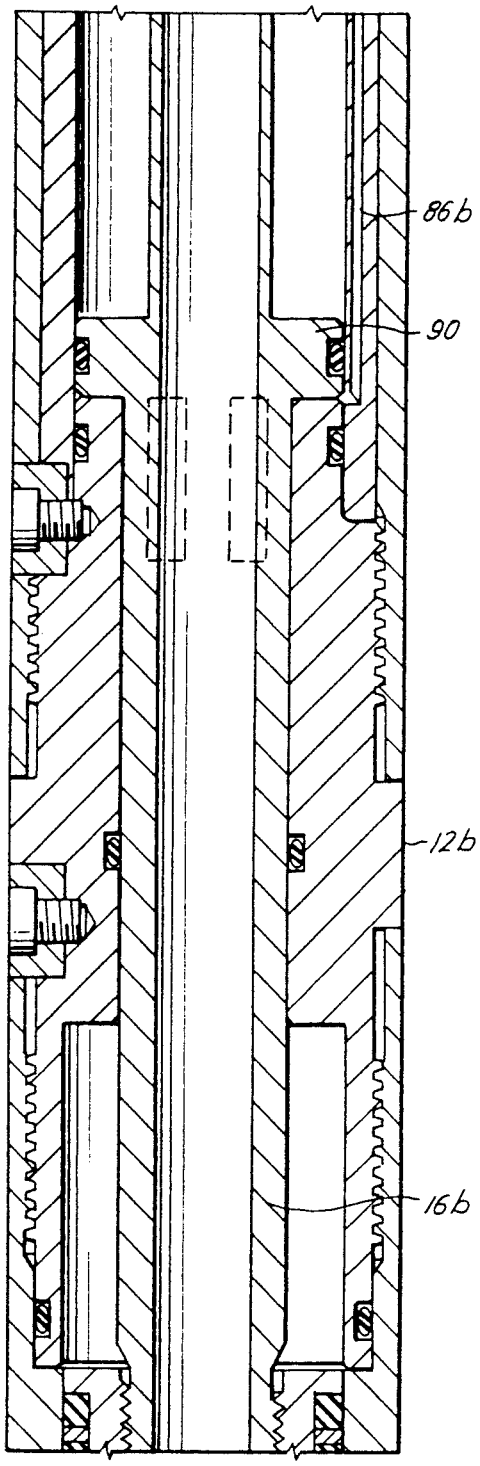
Figure 13C:
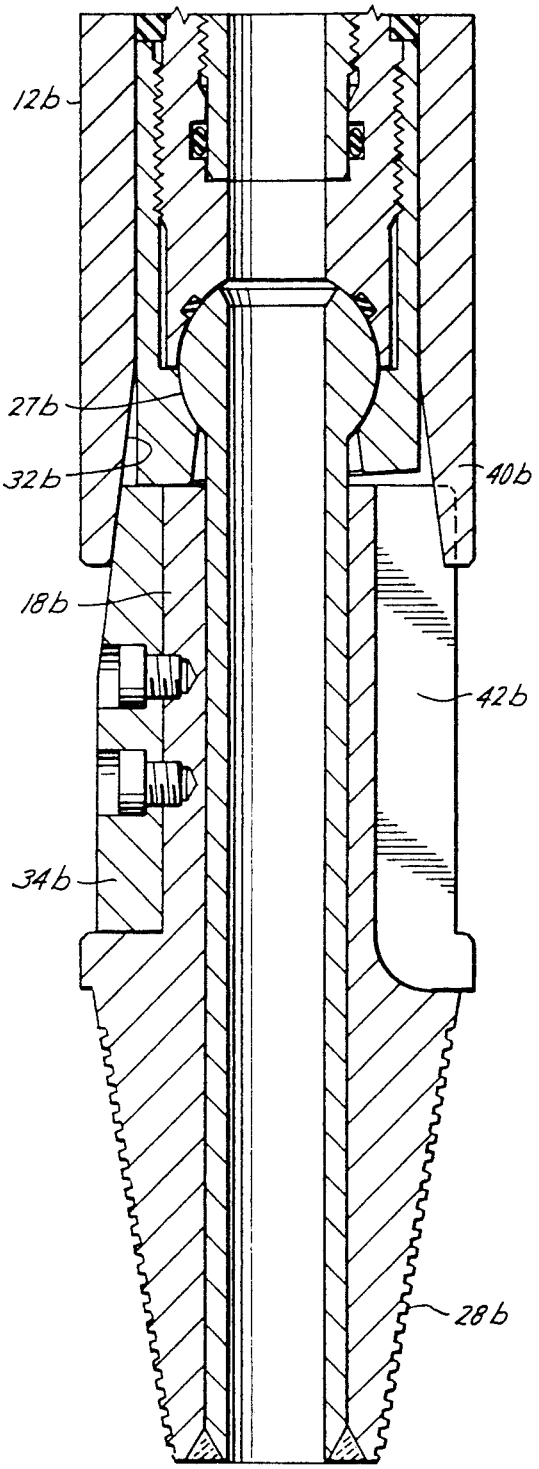

Referring now to FIGS. 13A, 13B and 13C, another embodiment is shown of a bent sub **10*b* in which when the housing 12*b* and the body 18*b* are moved towards each other causing the body 18***b* to rotate out of vertical alignment into a deviated angle determined by the cam surfaces 30*b* and 32*b*. In this embodiment, a piston 90 (FIG. 13B) is connected to the mandrel 16*b*. A supply of hydraulic fluid to the underside of the piston 90 will raise the mandrel 16*b* and move the body 18*b* into the housing 12*b* automatically moving the bent sub 12*b* to the desired angular position without having to set down as in the other embodiments. Also in this embodiment no locking dogs are required as the piston 90 is held in an upper retracted position by hydraulic fluid on the underside for locking the bent sub in the deviated angled position. The sub 10*b* is unlocked by the application of hydraulic fluid through line 88*b* (FIG. 13A) to the upper side of the piston 90. The electrical and hydraulic controls of the embodiment of 13A–13C are identical to the embodiment described in the embodiment of FIGS. 5A–5C. That is, an electrically actuated solenoid pump 74*b* supplies hydraulic fluid from a reservoir 76*b* to an electrically actuated solenoid valve 72*b* having a spool 82*b*. In one position, the spool 82*b* directs fluid from the pump 74*b* through the line 86*b* to the underside of the piston 90 for actuating the bent sub 10*b* into the deviated angled position and locked in that position. Movement of the spool 82*b* in the opposite direction directs fluid from the pump 74*b* through a line 86*b* to the upper side of the piston 90 for unlocking and moving the bent sub to a vertical position.

The present invention, therefore, is well adapted to carry out the objects and attain the ends and advantages mentioned as well as others inherent therein. While presently preferred embodiments of the invention have been given for the purpose of disclosure, numerous changes in the details of construction will be readily apparent to those skilled in the art and which are encompassed within the spirit of the invention and the scope of the appended claims.

What is claimed is:

1. A movable joint bent sub for attachment in a well conduit for use in deviated drilling of a well comprising, an elongate housing having a bore therein and having first and second ends, the first end having connecting means for attachment in a well conduit, a mandrel telescopically movable in the bore, a movable body having first and second ends, said first end of said movable body having connecting means for attachment in the well conduit, said second end of said movable body pivotally connected to the mandrel and slidable into the second end of the housing, and coacting cam surfaces on the body and the housing for pivoting the second end of the body when the mandrel is telescopically moved in the bore.

2. The sub of claim 1 including, means preventing rotation of the body around its longitudinal axis relative to the housing.

3. The sub of claim 2 wherein said preventing means includes a key and a coacting keyway, one of which is on the housing and other of which is on the body.

4. The sub of claim 1 wherein the pivot is a universal joint.

5. The sub of claim 1 wherein the cam surface on the body is a replaceable insert for providing different degrees of pivoting angle with different inserts.

6. The sub of claim 1 including, a shoulder on the mandrel for engaging the body when the body is pivoted.

7. The sub of claim 6 wherein the angle of the shoulder is variable.

8. The sub of claim 1 including, releasable locking means between the mandrel and the housing.

9. The sub of claim 8 wherein the locking means includes electrical locking means.

10. The sub of claim 8 including, a piston connected to the mandrel, and said locking means including hydraulic locking means.

11. The sub of claim 10 wherein the locking means includes an electrically actuated pump and valve.

12. The sub of claim 8 wherein the locking means includes a hydraulic piston actuated lock.

13. The sub of claim 12 including an electrically actuated pump and valve controlling the piston actuated lock.

* * * * *